United States Patent [19]

Rodewald

[11] Patent Number: 4,634,342

[45] Date of Patent: Jan. 6, 1987

[54] BLOWER FOR AGRICULTURAL SPRAYING

[76] Inventor: Wilhelm H. A. Rodewald, 31 George Starck Drive, Oostersee, Cape Province, South Africa

[21] Appl. No.: 633,329

[22] Filed: Jul. 23, 1984

[51] Int. Cl.[4] ..... B05B 7/24; F04D 29/54

[52] U.S. Cl. ..... 415/209; 239/77

[58] Field of Search ..... 415/182, 148, 203, 206, 415/207–209, 213 C, 210, 219 R, 150; 239/77, 78

[56] References Cited

U.S. PATENT DOCUMENTS

| | | | |
|---|---|---|---|
| 2,538,739 | 1/1951 | Troller | 415/207 UX |
| 3,334,807 | 8/1967 | McMahan | 415/207 |
| 4,258,271 | 3/1981 | Chappell et al. | 415/206 X |
| 4,318,693 | 3/1982 | Gutzwiller | 415/206 X |
| 4,391,564 | 7/1983 | Garkusha et al. | 415/210 X |

FOREIGN PATENT DOCUMENTS

| | | | |
|---|---|---|---|
| 1338515 | 8/1963 | France | 415/209 |

OTHER PUBLICATIONS

Holder Brochure, "Pflanzenchultz in Obstbau", Jun. 1983.

*Primary Examiner*—Robert E. Garrett
*Assistant Examiner*—Joseph M. Pitko
*Attorney, Agent, or Firm*—Pollock, Vande Sande & Priddy

[57] ABSTRACT

An air blower (particularly for agricultural spraying purposes) comprises a fan, an annular fan housing, a curved air deflector downstream of the fan, and a curved air-flow divider. The fan housing has a frusto-conical intake section and a curved outflow section. The outflow section, the air deflector and the air-flow divider each correspond to a surface generated by rotating a curve having a center of curvature C about the axis of rotation of the fan. There is a back plate, the arrangement being such that distance D4 is about half the distance D3. The maximum radial extent of the air-flow divider is less than that of the outflow section and the back plate.

4 Claims, 1 Drawing Figure

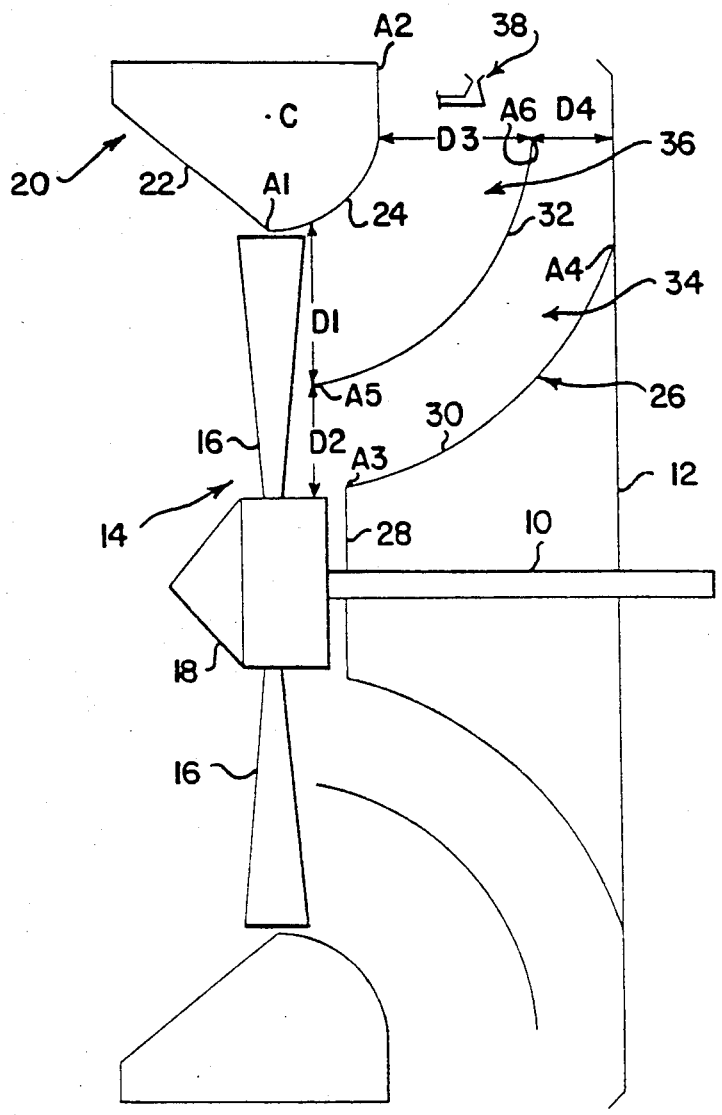
A2
38
C
A6
D4
D3
36
20
22
A1
24
32
A4
34
D1
A5
26
30
16
D2
A3
12
14
28
10
18
16

BLOWER FOR AGRICULTURAL SPRAYING

FIELD OF THE INVENTION

This invention relates to air blowers.

BACKGROUND OF THE INVENTION

In the design of blowers, a primary aim is to achieve a configuration which will displace as much air as possible for the consumption of the least amount of power.

OBJECT OF THE INVENTION

The present invention thus seeks to provide a blower in which the ratio of power to air volume displaced is more advantageous than with other blowers of which applicant is aware. The present invention also seeks to provide a blower which provides an air flow pattern which renders it suitable for agricultural spraying purposes.

SUMMARY OF THE INVENTION

According to one aspect of the present invention, there is provided an air blower comprising a fan housing, a fan co-axial with and within the fan housing, the fan housing including an air intake section of frusto-conical form tapering from an inlet end towards the fan and an outflow section on the pressure side of the fan, said outflow section increasing in area with distance from the fan and being bounded by a surface generated by rotating an arc about the axis of rotation of said fan, said sections meeting radially outwardly of the fan.

According to another aspect of the present invention, there is provided an air blower comprising a fan housing, a fan co-axial with and within the fan housing, the fan housing including an outflow section on the pressure side of the fan, said outflow section increasing in area with distance from the fan and being bounded by a surface generated by rotating a first arc about the axis of rotation of said fan, a cone-like air deflector on the pressure side of the fan and co-axial with said fan, said air deflector increasing in diameter with increasing distance from the fan and being of the form generated by rotating a second arc about the axis of rotation of the fan, and an air flow divider of conical form on the pressure side of said fan, the flow divider being between the fan housing and the air deflector, increasing in diameter with increasing distance from the fan, and having the form generated by rotating a third arc about the axis of rotation of the fan.

At least the first and third arcs, and preferably also the second arc, may be co-axial with one another.

Said air deflector preferably has a disc-like end wall of substantially the same diameter as the hub of the fan.

The blower can include a disc-like back plate with said air deflector between the fan and said back plate, said back plate extending radially outwardly of the wider end of said flow deflector and having substantially the same diameter as the maximum diameter of said outflow section, the maximum diameter of said air divider being less than the maximum diameters of said outflow section and said back plate. The radial spacing between the hub of the fan and the upstream end of the flow divider can be substantially equal to the distance between said upstream end of the flow divider and the fan housing.

The spacing between the maximum diameter end of the flow divider and said back plate can be approximately half the spacing between the flow divider and the maximum diameter end of the outflow section, such spacings being measured axially of the blower, the flow divider converging with the back plate radially outwardly of the circular outer edge of the air deflector.

BRIEF DESCRIPTION OF DRAWING

For a better understanding of the present invention, reference will now be made, by way of example, to the accompanying diagrammatic drawing in which the single FIGURE is a diametral section through a blower in accordance with the present invention.

DETAILED DESCRIPTION OF PREFERRED EMBODIMENT

The blower illustrated comprises a drive shaft 10 which passes through a circular back plate 12 of the blower. The shaft 10 is driven by a suitable motor such as a diesel engine or an electric motor (not shown) and is mounted in suitable bearings (not shown). A fan 14 is mounted on the shaft 10, the fan 14 comprising multiple blades 16 and a hub 18. The drive shaft could, in an alternative construction, extend in the opposite direction to that shown. The motor in this form is mounted in a casing lying on the air intake side of the fan.

The fan casing (also referred to as a cowling) is designated 20 and is in the form of an annulus which encircles the fan 14. The casing 20 includes an intake section 22 which is of conical form and which narrows towards the fan 14. Thus the area of the intake section 22 decreases steadily from left to right as illustrated in the drawing. Radially outwardly of the fan 14, the section 22 joins a curved section 24. The section 24 is of the form generated by rotating the arc designated between points A1 and A2 about the axis of the shaft 10. The arc A1, A2 is such that its end A1 extends approximately parallel to the axis of the shaft 10, and that its other end A2 extends radially outwardly with respect to the axis of the shaft 10.

A cone-like air deflector 26 is mounted on the back plate 12. The air deflector 26 has a disc-shaped end surface 28 which is behind the hub 18 and a generally conical surface 30 which extends from the surface 28 to the inner face of the back plate 12. The surface 30 is generated by rotating an arc A3, A4 about the axis of the shaft 10.

Between the section 24 and the surface 30 there is a substantially conical air flow divider 32. The flow divider 32 is generated by rotating the arc A5, A6 about the axis of the shaft 10.

Reference letter C designates a center point. When a radial section through the structure described is considered, it will be seen that the first, major part of the section 24 (from the point A1), the surface 30, and the divider 32 are all generated about this single center point. Thus, while these components are of different diameters, they are, in any radial plane, co-axial with one another about the point C which lies in the radial plane under consideration. The point C is furthermore aligned radially with the blades 16. The last, minor part of the section 24 (up to the point A2) extends in a straight line radially outwardly.

The radially outer end of the section 24 and the circular edge of the back plate 12 lie at approximately the same radial distance from the axis of the shaft 10 as one another. The circular outer edge of the flow divider 32 lies radially inwardly of the circular outer edges of the section 24 and of the back plate 12. Because the back plate 12 extends radially and the flow divider 32 converges with it, the width of the gap between the flow divider 32 and the back plate 12 decreases with increasing distance from the axis of the shaft 10.

The distance D1 between the section 24 and the flow divider 32 is substantially equal to the distance D2 between the flow divider 32 and the outer face of the hub 18. The distance D3 between the section 24 and the flow divider 32 is approximately the same as D1, whereas the distance D4 is approximately half of D2, and hence half of D3.

When the fan 14 rotates, air is drawn through the section 22 and fed into the inner and outer annular passages designated 34 and 36. The air velocity in the passage 34 is substantially lower than in the passage 36. This is an inherent characteristic of the fan. Air flowing from the outer passage 36 past the radially outer edge of the flow divider 32, because of the illustrated configuration, exerts a suction effect on the air in the inner passage 34 which increases its flow rate.

Experimental work has shown that the power required to displace a given volume of air using the blower described is less than with other blowers of which applicant is aware.

The blower illustrated is primarily intended for agricultural use and specifically for spraying trees. At the regions designated 38, spray nozzles (shown schematically) are fitted which are connected to a supply of liquid under pressure. The liquid is atomized as it is forced through the nozzles, and is carried by the flowing airstream as a mist into the trees being sprayed. Experimental work has also shown that the airflow pattern that the blower creates promotes penetration of the spray into the trees.

I claim:

1. An air blower for agricultural spraying purposes, the blower comprising a fan housing; a fan co-axial with and within the fan housing, the fan having a hub and the fan housing including an outflow section on the pressure side of the fan, said outflow section increasing in area with distance from the fan and being bounded by a surface generated by rotating a first arc about the axis of rotation of said fan; a cone-like air deflector on the pressure side of the fan and co-axial with said fan, said air deflector increasing in diameter with increasing distance from the fan and being of the form generated by rotating a second arc about the axis of rotation of the fan; an air flow divider of conical form on the pressure side of said fan, the flow divider being between the fan housing and the air deflector, increasing in diameter with increasing distance from the fan, and having the form generated by rotating a third arc about the axis of rotation of the fan; and a disc-like back plate with said air deflector between the fan and said back plate, said back plate extending radially outwardly of the wider end of said air deflector and having substantially the same diameter as the maximum diameter of said outflow section, the maximum diameter of said flow divider being less than the maximum diameter of said backplate, and the spacing between the maximum diameter end of the flow divider and said back plate being substantially less than the spacing between the flow divider and the maximum diameter end of the outflow section, such spacings being measured axially of the blower, the flow divider converging with the back plate radially outwardly of the circular outer edge of the air deflector.

2. An air blower according to claim 1, wherein said air deflector has a disc-like end wall adjacent the hub and of substantially the same diameter as the hub.

3. An air blower according to claim 2 wherein the radial spacing between the hub and the upstream end of the flow divider is substantially equal to the distance between said upstream end of the flow divider and the fan housing.

4. An air blower comprising a fan housing; a fan co-axial with and within the fan housing, the fan having a hub and the fan housing including an outflow section on the pressure side of the fan, said outflow section increasing in area with distance from the fan and being bounded by a surface generated by rotating a first arc about the axis of rotation of said fan; a cone-like air deflector on the pressure side of the fan and co-axial with said fan, said air deflector increasing in diameter with increasing distance from the fan and being of the form generated by rotating a second arc about the axis of rotation of the fan; and an air flow divider of conical form on the pressure side of said fan, the flow divider being between the fan housing and the air deflector, increasing in diameter with increasing distance from the fan, and having the form generated by rotating a third arc about the axis of rotation of the fan; and wherein the spacing between the maximum diameter end of the flow divider and said back plate is approximately half the spacing between the flow divider and the maximum diameter end of the outflow section, such spacings being measured axially of the blower, the flow divider converging with the back plate radially outwardly of the circular outer edge of the air deflector.

* * * * *